US005385252A

United States Patent [19]

Hidding et al.

[11] Patent Number: 5,385,252

[45] Date of Patent: Jan. 31, 1995

[54] CLOSURE

[76] Inventors: Walter E. Hidding, 367A Woodrock Rd., Barrington Hills; Douglas J. Hidding, 801 E. Lake Shore Dr., Barrington, both of Ill. 60010; Robert D. Hidding, 925 Harper Dr., Algonquin, Ill. 60102

[21] Appl. No.: 902,170

[22] Filed: Jun. 26, 1992

[51] Int. Cl.[6] ..... B65D 41/00

[52] U.S. Cl. ..... 215/230; 215/256; 215/344; 215/354; 215/DIG. 1

[58] Field of Search ..... 215/343, 344, DIG. 1, 215/254, 255, 256, 230, 354; 220/276

[56] References Cited

U.S. PATENT DOCUMENTS

| | | | |
|---|---|---|---|
| 3,232,470 | 2/1966 | Gibson | 215/344 |
| 3,527,372 | 9/1970 | Manning | 220/296 |
| 3,901,404 | 8/1975 | Feldman | 215/256 |
| 4,131,212 | 12/1978 | Rumball | 215/252 |
| 4,566,603 | 1/1986 | Moore | 215/329 |
| 4,573,599 | 3/1986 | Fillmore | 215/225 |
| 4,687,114 | 8/1987 | Crisci | 215/256 |
| 4,790,448 | 12/1988 | Ostrum et al. | 220/270 |

*Primary Examiner*—Allan N. Shoap
*Assistant Examiner*—Nova Stucker
*Attorney, Agent, or Firm*—David I. Roche

[57] ABSTRACT

An injection molded threaded cap for use with containers of varying dimensions. The cap of the present invention includes a cover from which depends an integral plug. An auxiliary sealing ring is disposed at the outside base of the plug to compensate for differences between the diameter of the plug and the diameter of the opening to be sealed by the cap. To prevent doming of the cover of the cap, the underside of the cover has shrinkage resistance formations which provide the cap with structural resistance to the effects of shrinkage. The cap of the present invention further includes a ratchet ring having ratchet teeth designed to enhance the tamper-evidency of the frangible ratchet ring.

5 Claims, 2 Drawing Sheets

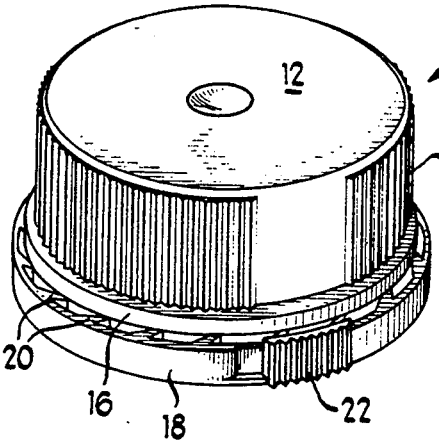
Fig 1
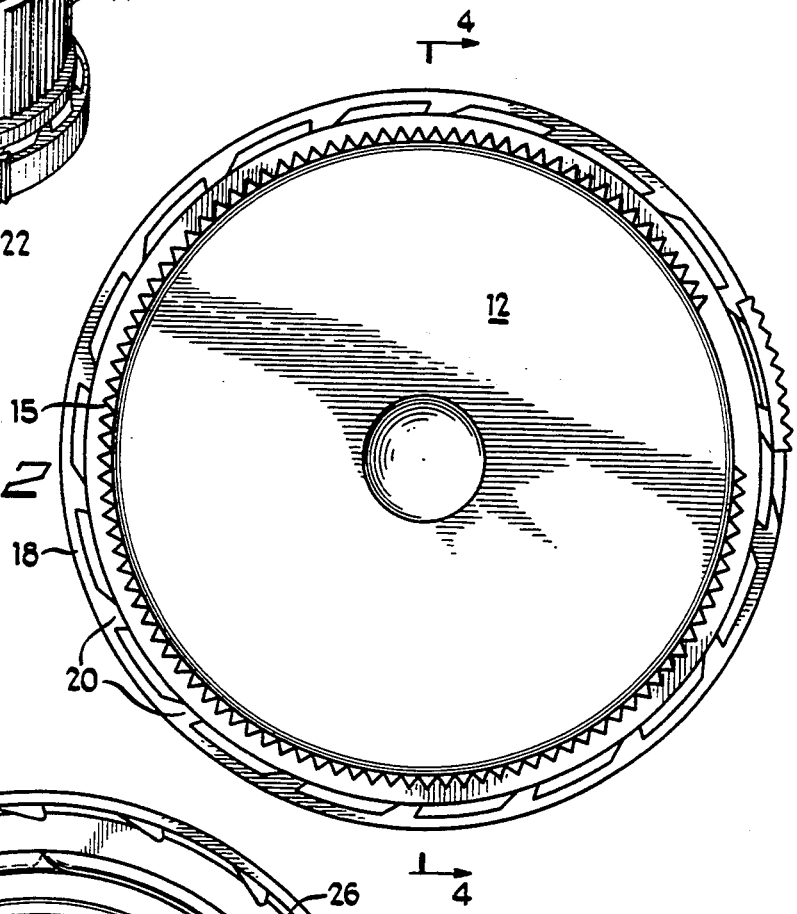
Fig 2
Fig 3
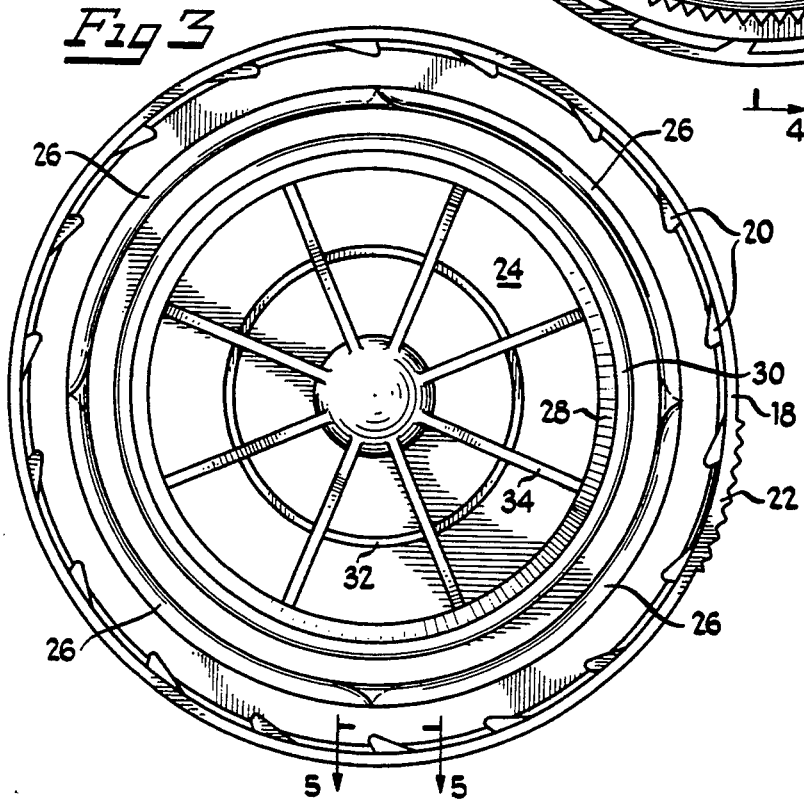

CLOSURE

BACKGROUND AND SUMMARY OF THE INVENTION

The present invention relates to closure devices, and in particular, relates to injection molded caps for containers which hold liquid, such as milk.

Injection molded caps for blow molded milk bottles have been used for many years. Generally, two types of caps are available, push-on caps and thread-on caps. Push-on caps are installed by aligning the cap with the opening of a container and simply applying an axial force to the top of the cap. Thread-on caps generally require that the cap and container be aligned and that a rotative force be applied to the cap. In some cases, threaded caps, if carefully designed in conjunction with the container to which it is applied, can be made so that the rotative force required to install the cap is minimized or even eliminated. These kinds of injection molded caps are often made with low density polypropylene, a common material used in injection molding.

One of the problems associated with injection molded caps relates to dimensional stability. Polypropylene and other injection moldable materials tend to shrink when they are cooled. The amount of shrinkage is difficult to quantify, and depends on factors such as temperature, the presence or absence of additives such as pigments, the configuration of the product, and other factors. Another aspect of dimensional stability relates to the deformability of the cap at the time it is ejected from the mold. When the cap is still warm after being formed in the mold, forces required to eject the cap can cause deformation of the cap. In some cases, this results in permanent changes in the shape of the product.

Another problem arising from the use of plastic caps and blow molded bottles relates to the seal which must be created between these two components. The imprecise nature of blow molding requires that cap designs be forgiving. Caps must be designed for a wide range of bottle neck shapes, since it is difficult to blow mold containers within tight tolerances.

The problem of matching a blow molded bottle neck with an injection molded cap manifests itself both with respect to the sealing of the two components and with respect to the formation of a tamper-evident connection between the two components. For example, plug-type caps have a downwardly depending plug formed on the underside of the cap. The plug is intended to seal against the inner edge of a lip formed at the top of a container. If the plug of the cap shrinks and the diameter of the container neck at the lip does not properly match the shrunken size of the plug, an effective seal may not be possible. Similarly, many threaded caps include a ratchet ring formed at the lower periphery of the cap. The ratchet ring engages matching ratchet teeth formed on a bottle neck. If the dimensional stability of the components is not sufficient, the tamper-evidency provided by the ratchet ring will not be accomplished.

It is therefore an object of the present invention to provide a cap with improved dimensional stability.

Another object of the present invention is to provide a cap in which the effects of shrinkage are reduced.

Yet another object of the present invention is to provide a cap having improved sealing characteristics with respect to bottle containers which are manufactured to relatively loose tolerance requirements.

Still another object of the present invention is to provide an improved tamper-evident cap.

A further object of the present invention is to provide a tamper-evident threaded cap with an improved ratchet ring which prevents removal of the cap unless the ratchet ring has previously been removed.

These and other objects of the present invention are achieved with a threaded cap which is comprised of a generally flat circular cover with a depending skirt extending from the periphery of the cover. At the bottom of the skirt, a ratchet ring is frangibly connected to the skirt. The ratchet ring includes a plurality of inwardly directed ratchet teeth. The underside of the cover includes various formations which tend to resist deformation of the cap which tends to occur as a result of shrinkage of the material comprising the cap. The cap includes a sealing plug and an auxiliary sealing ring disposed at the outside base of the sealing plug. The auxiliary sealing ring creates a seal against the top surface of a container neck, and will create a seal even if the sealing plug does not fit tightly against the inside edge of the container neck. The ratchet teeth on the tamper-evident ratchet ring are shaped to enhance the locking action of the teeth. The abutting face of each tooth is sloped so that the bottom edge of the tooth is offset with respect to the upper part of the tooth in the direction of unscrewing the cap.

BRIEF DESCRIPTION OF THE DRAWINGS

The objects and advantages of the present invention will be better understood by reading the following specification read in conjunction with the accompanying drawings wherein:

FIG. 1 is a perspective view of a cap of the present invention;

FIG. 2 is a top view of the cap shown in FIG. 1;

FIG. 3 is a bottom plan view of the cap shown in FIGS. 1 and 2;

DETAILED DESCRIPTION OF THE INVENTION

Figure 4:
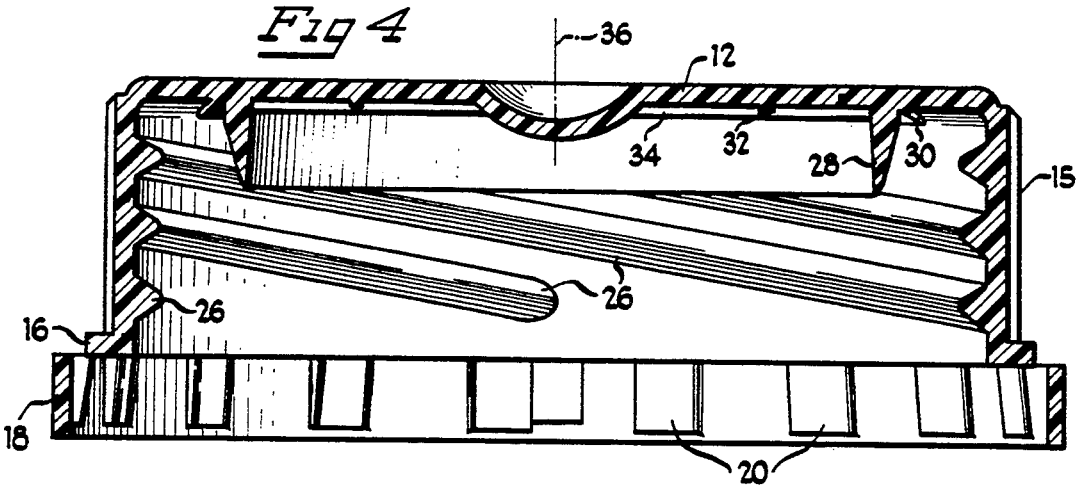
FIG. 4 is a cross-sectional view taken along line 4—4 of FIG. 2.

FIGS. 1 and 2 generally depict the outside of a cap 10. The cap 10 is comprised of a cover 12 and a depending skirt 14 with knurls 15 formed on the outside surface thereof. A bottom flange 16 is formed at the bottom of the skirt, and a ratchet ring 18 is frangibly connected to the bottom flange 16. The ratchet ring 18 includes a plurality of ratchet teeth 20, and a pull-tab 22.

A smooth section 17 of the outside surface of the skirt 14 has no knurls. The smooth section 17 has a width about equal to the width of the pull-tab 22, and extends generally the full height of the skirt 14. The unknurled area 17 serves to clearly identify the location of the pull-tab 22, since the pull-tab 22 itself has a low profile and blends somewhat with the rest of the ratchet ring 18.

FIG. 3 shows the underside 24 of the cover 12. Four distinct threads 26 are formed on the inside surface of the skirt 14. A plug 28 and an auxiliary sealing ring 30 are also formed on the underside 24 of the cover 12.

Caps generally, and threaded caps in particular, tend to shrink most where there is substantial differential in volume of plastic material. Caps which are injection molded tend to shrink in such a way as to deform an initially flat cover 12 into a dome-shaped surface. Significant volume of material is required to form threads which are sufficiently strong to hold the cap 10 in place. The cover 12, on the other hand, needs only to have sufficient thickness to withstand puncturing forces. The shrinkage of the cap 10 to form a dome ("doming") creates problems as it relates to dimensional stability and sealing effectiveness, and sometimes causes problems relating to the affixing of a label on the top of the cover 12. For example, radially inward shrinkage will tend to reduce the outside diameter of the plug 28. To reduce the effects of shrinkage, the cap 10 has means for limiting the doming of the cover 12. A circumferential rib 32 is disposed about midway between the center of the cap 10 and the plug 28. Eight radial ribs 34 extend from the center of the cap 10 to the plug 28. The circumferential rib 32 and radial ribs 34 provide the cover 12 with structural integrity sufficient to withstand the tendency for the cover 12 to assume a domed shape. In addition, by providing the cover 12 with additional volume of plastic material, the differential in material volume between the cover and the skirt is reduced, which tends to further reduce the distorting effects of shrinkage.

Figure 6:
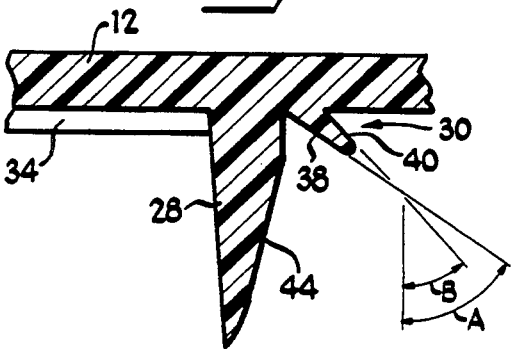
FIG. 6 is an enlarged cross-sectional view of a plug and auxiliary sealing ring of the present invention.

FIGS. 4 and 6 more clearly show the location and configuration of the auxiliary sealing ring 30. The plug 28 is a generally circumferentially continuous formation having a thickness approximately equal to the thickness of cover 12 and being integrally connected to the underside 24 of the cover 12. The auxiliary sealing ring 30 is also circumferentially continuous, and extends downwardly and outwardly from the base of the plug 28. Both the plug 28 and the auxiliary sealing ring 30 are disposed about the central axis 36 of the cap 10. The auxiliary sealing ring 30 is a thin flexible ring designed to engage the top surface of a container neck finish. The lower surface 38 makes an angle A with a line V, which is parallel to the axis 36, of about 55°. The upper surface 40 makes an angle B of about 45° with respect to the line V. The rounded tip 42 of the auxiliary sealing ring 30 has a radius of about 0.005 inches, and the average thickness of the auxiliary sealing ring 30 is about 0.015 inches. The plug 28 has an outer surface 44 which is frustoconical about the axis 36. Similarly, the upper and lower surfaces 40 and 38 respectively of the auxiliary sealing ring 30 are also frustoconical about the axis 36. It is important in order to achieve proper sealing that the surfaces which comprise the plug 28 and the auxiliary sealing ring 30 be frustoconical and concentric about the central axis of the cap 10.

Figure 5:
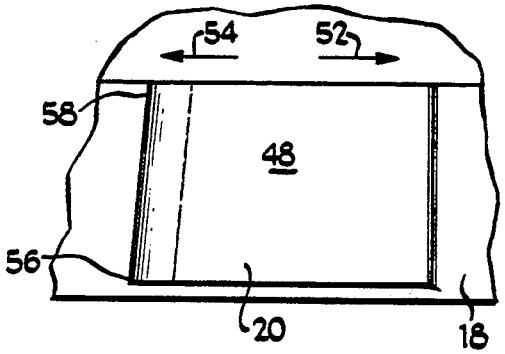
FIG. 5 is an enlarged elevational view taken along line 5—5 of FIG. 3.
Figure 7:
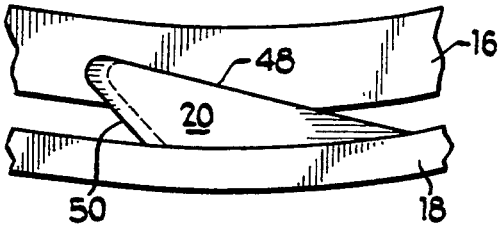
FIG. 7 is an enlarged end view of the tooth shown in FIG. 5.

FIGS. 5 and 7 more clearly show the configuration of the ratchet teeth 20. Each tooth 20 is comprised of a ramp surface 48 and an abutting surface 50. FIG. 7 is a bottom view of the tooth 20 shown in FIG. 5. Arrow 52 indicates the direction in which the cap 10 moves when the cap 10 is installed or tightened. Arrow 54 indicates the direction required to unscrew the cap 10. The abutting surface 50 of the tooth 20 is sloped in such a way that the lower edge 56 of the tooth 20 is offset with respect to the upper portion 58 of the tooth 20 in the direction of unscrewing the cap 10. As a result, as the tooth 20 engages a mating ratchet tooth on a bottle neck, the bottom edge 56 of the tooth 20 will engage the mating ratchet tooth first. The sloping nature of the surface 50 will enhance the grouping engagement of the tooth 20, and will resist unintended camming or slippage of the teeth 20 on the cap 10 relative to the matching ratchet teeth on the bottle neck.

Again, because of the difficulty in maintaining tolerances when blow molding plastic bottles, it is important to design caps so that they can accommodate bottle necks of varying dimensions. This is particularly the case since bottle caps are often made in a relatively controlled manufacturing facility, whereas blow molded containers are often made on-site in dairies and other bottling facilities where it is difficult to carefully control dimensions of the containers and where blow molding is done without benefit of experienced operators. The shrinkage control, sealing and tamper-evident features of the present invention are intended to overcome the difficulty of ensuring an effective seal between an injection molded cap and a blow molded bottle.

While a specific embodiment of the invention has been shown and described, it will be apparent to those skilled in the art that numerous alternatives, modifications, and variations of the embodiment shown can be made without departing from the spirit and scope of the appended claims.

We claim:

1. A closure comprising a cover, a skirt depending from the periphery of said cover, said skirt having means formed on its interior surface for retaining said closure to a container, a plug extending downwardly from the underside of said cover, said plug being a circumferentially continuous formation having a generally tapered outer surface disposed about a central axis of said closure, said surface for sealingly engaging an inwardly extending flange of a container neck finish, an auxiliary sealing ring adjacent to said plug, said auxiliary sealing ring being flexible and circumferentially continuous, said closure including a tamper-evidencing ring removably connected to said skirt, said ring having starting means comprising a section of said ring with reduced thickness for facilitating breakage and removal of said ring, indicating means on an outside surface of said skirt for indicating the location of said starting means on said ring, said closure having threads formed on an inside surface of said skirt, and said removable retaining means being a ratchet ring, and said starting means being a pull-tab, said skirt having surface grasping means on an outside surface of said skirt, said indicating means comprising an interruption in said surface grasping means, said surface grasping means being comprised of a series of vertical, closely spaced ribs forming knurling, said interruption being disposed adjacent to and above said pull-tab, said interruption being both visible and capable of being felt.

2. A closure in accordance with claim 1 wherein:
said auxiliary sealing ring is comprised of a short, thin, angled rib extending downwardly from a point of intersection between said plug and said cover.

3. A closure in accordance with claim 2 wherein:
said auxiliary sealing ring is tapered and flexible such that said rib is thicker at its base than at its tip.

4. A closure in accordance with claim 3 wherein:
said auxiliary sealing ring has a generally frustoconical lower surface disposed at an angle of about 55° with respect to said axis, and said rib has a generally frustoconical upper surface disposed at an angle of about 45° with respect to said axis.

5. A closure for use with a blow-molded bottle neck, said closure comprising a cover, a skirt depending from the periphery of said cover, said skirt having threads formed on its interior surface for retaining said closure to a container, a rigid inner plug integrally formed with said cover, said plug having a thickness at its base approximately equal to the thickness of said cover and an outside surface of said plug being conical, whereby said closure can be removed axially from its mold without substantially deflecting said plug, an auxiliary sealing ring adjacent to said plug, said auxiliary sealing ring being flexible, said plug and said auxiliary sealing ring each being circumferentially continuous, said auxiliary sealing ring being tapered and extending downwardly and outwardly from an intersection of said plug and said cover.

* * * * *